United States Patent [19]

Grützmacher et al.

[11] Patent Number: 4,624,454

[45] Date of Patent: Nov. 25, 1986

[54] SHEET FEEDER FOR PRINTING MACHINES

[75] Inventors: Bertold Grützmacher, Dossenheim; Karl-Heinz Krestyn, Leimen, both of Fed. Rep. of Germany

[73] Assignee: Heidelberger Druckmaschinen AG, Heidelberg, Fed. Rep. of Germany

[21] Appl. No.: 772,170

[22] Filed: Sep. 3, 1985

[30] Foreign Application Priority Data

Sep. 1, 1984 [DE] Fed. Rep. of Germany ..... 3432198

[51] Int. Cl.[4] ..... B65H 3/08

[52] U.S. Cl. ..... 271/30.1; 101/231; 271/11; 271/97; 271/153

[58] Field of Search ..... 271/30.1, 31, 93, 97, 271/98, 11–15, 147, 152–156; 101/232, 238–241

[56] References Cited

U.S. PATENT DOCUMENTS

| | | | |
|---|---|---|---|
| 3,149,833 | 9/1964 | Rolon | 271/31 |
| 3,378,253 | 4/1968 | Jong-Dok-Kim | 271/155 |
| 4,480,826 | 11/1984 | Kaneko | 271/31 |

*Primary Examiner*—Duane A. Reger
*Assistant Examiner*—John A. Carroll
*Attorney, Agent, or Firm*—Herbert L. Lerner; Laurence A. Greenberg

[57] ABSTRACT

A sheet feeder of a printing machine has sheet separating and conveying facilities and a stack table which raises a stack of sheets by means of a controlled lift drive so that a respective uppermost sheet of the stack is in an operating position for the sheet separating and conveying facilities, the sheet separating facility including separating suckers for raising, in timed sequence, a respective trailing sheet end, as viewed in sheet conveying direction through the feeder, a suction line connecting the separating suckers to a suction source, a pressure measuring device connected in the suction line for determining an actual instant of time at which a respective sheet is sucked up by the separating suckers, a comparator device for comparing the actual suction instant of time with a nominal suction instant of time generated in synchronism with rotation of the printing machine to determine a difference value, a comparator device for comparing the difference value with a value corresponding to an optimum height of the stack of sheets, and a lift drive for raising the stack of sheets to compensate for a given deviation of the difference value from the optimum height value.

4 Claims, 2 Drawing Figures

Figure 1:
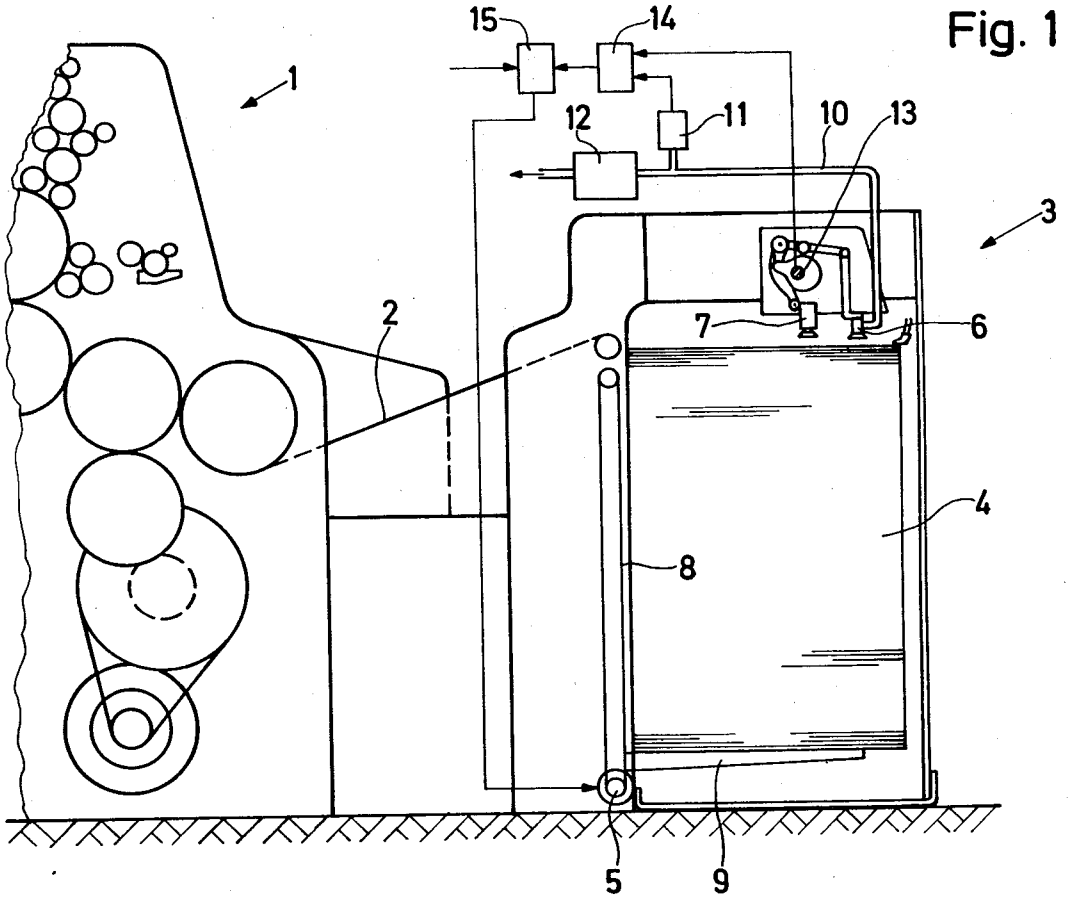

1
2
3
4
5
6
7
8
9
10
11
12
13
14
15

SHEET FEEDER FOR PRINTING MACHINES

The invention refers to a sheet feeder of a printing machine having sheet separating and conveying facilities and having a stack table which raises a stack of sheets by means of a controlled lift drive so that a respective uppermost sheet of the stack is in an operating position for the sheet separating and conveying facilities, and separating suckers which raise in timed sequence a respective trailing sheet end, as viewed in sheet conveying direction through the feeder.

A conventional sheet feeder with a device for raising the stack table (German Pat. No. 1,181,717) uses a blower foot or gooseneck resting on the surface of the stack for controlling the stack lifting facility. If single sheets are removed from the surface of the stack of sheets and advanced or conveyed onward, the blower foot or a stack sensor, via a lug and moving sensor tip, releases a displaceable control pin which rests on the tip of the sensor and with which an electrical switch is operatively associated. The electrical switch, in turn, actuates the lifting system or facility so that the surface of the stack moves into the effective range of the separating device and the suckers.

The disadvantage of the foregoing conventional sheet-feeder construction is that the blower foot or the stack sensor comes to rest against the outer edge of the stack of sheets and, due to the often poorly flattened disposition of the sheets thereat, determines or detects an arbitrary height measurement which, for example, does not agree with the height measurement in the vicinity of the separating suckers. If the separating suckers for raising and transporting the sheets should be of marked significance in the operation of the aforementioned conventional sheet feeder, malfunctions can occur in the system which are caused, for example, by a stack of sheets which do not lie flat. The conventional sheet feeder is therefore unable to ensure reliable and exact suction of the separating and conveying facilities in every working position It is an object of the invention, therefore, starting from this heretofore known state of the art, to provide an improvement in a sheet feeder with a controlled lift drive of the stack of sheets which ensures reliable operation of the separating and conveying systems or facilities at all machine speeds and for all sheet materials to be processed.

With the foregoing and other objects in view, there is provided, in accordance with the invention, a sheet feeder of a printing machine having sheet separating and conveying facilities and a stack table which raises a stack of sheets by means of a controlled lift drive so that a respective uppermost sheet of the stack is in an operating position for the sheet separating and conveying facilities, the sheet separating facility comprising separating suckers for raising, in timed sequence, a respective trailing sheet end, as viewed in sheet conveying direction through the feeder, a suction line connecting the separating suckers to a suction source, pressure measuring means connected in the suction line for determining an actual instant of time at which a respective sheet is sucked up by the separating suckers, means for comparing the actual suction instant of time with a nominal suction instant of time generated in synchronism with rotation of the printing machine to determine a difference value, means for comparing the difference value with a value corresponding to an optimum height of the stack of sheets, and lift drive means for raising the stack of sheets to compensate for a given deviation of the difference value from the optimum height value. A considerable advantage of the construction according to the invention lies in the fact that the stack lift drive and, accordingly, the respective position of the uppermost sheet are controlled by the position of the separating and conveying systems or facilities themselves so that the surface of the sheet can be held in the optimum position in the vicinity of the separating and conveying facilities. Even in the case of a wave-shaped or uneven stack surface, the sheet feeder according to the invention ensures that the separating and conveying facilities find a working height of the respective region of the sheet to be fed which ensures reliable and exact operation of these facilities even at high speed.

In accordance with a further feature of the invention, there is provided, a sheet feeder of a printing machine having sheet separating and conveying facilities and a stack table which raises a stack of sheets by means of a controlled lift drive so that a respective uppermost sheet of the stack is in an operating position for the sheet separating and conveying facilities, the sheet separating facility including separating suckers for raising, in timed sequence, a respective trailing sheet end, as viewed in sheet conveying direction through the feeder, drive means for the separating suckers having a rotary pulse generator operatively associated therewith, a suction line connecting the separating suckers to a suction source, a pressure sensor connected in the suction line for detecting an actual instant of time at which a respective sheet is sucked up by the separating suckers, comparator circuit means for comparing signals from the pressure sensor corresponding to the actual suction time instant with signals from the rotary pulse generator and outputting a signal corresponding to a time difference value, and comparator means for comparing the signal corresponding to the time difference value with a signal corresponding to an optimum height of the stack of sheets, and lift drive means for raising the stack of sheets to compensate for a given deviation of the difference value from the optimum height value.

In accordance with an added feature of the invention, there is provided, in a printing machine, a sheet feeder having sheet separating and conveying facilities, a stack table which raises a stack of sheets by means of a controlled lift drive so that a respective uppermost sheet of the stack is in an operating position for the sheet separating and conveying facilities, the sheet separating facility comprising at least one separating sucker for raising, in timed sequence, a respective trailing sheet end, as viewed in sheet conveying direction through the feeder, a suction line connecting the separating sucker to a suction source, a pressure sensor connected in the suction line of the separating sucker, means for driving the separating sucker, an angular pulse generator operatively associated with the separating sucker, an angular step generator operatively associated with a main drive of the printing machine, a comparator circuit having inputs for receiving sgnals from the pressure sensor, the angular pulse generator and the angular step generator and having an output for a signal corresponding to the angular difference determined in the comparator circuit, comparator means for comparing the signal corresponding to the angular difference with a signal corresponding to an optimum height of the stack of sheets, and control means for actuating the lift drive for a period of time corresponding to a deviation in the signals.

In accordance with a concomitant feature of the invention there is provided means for varying the nominal suction instant of time as a function of printing speed.

Other features which are considered as characteristic for the invention are set forth in the appended claims.

Although the invention is illustrated and described herein as embodied in a sheet feeder for printing machines, it is nevertheless not intended to be limited to the details shown, since various modifications and structural changes may be made therein without departing from the spirit of the invention and within the scope and range of equivalents of the claims.

Figure 2:
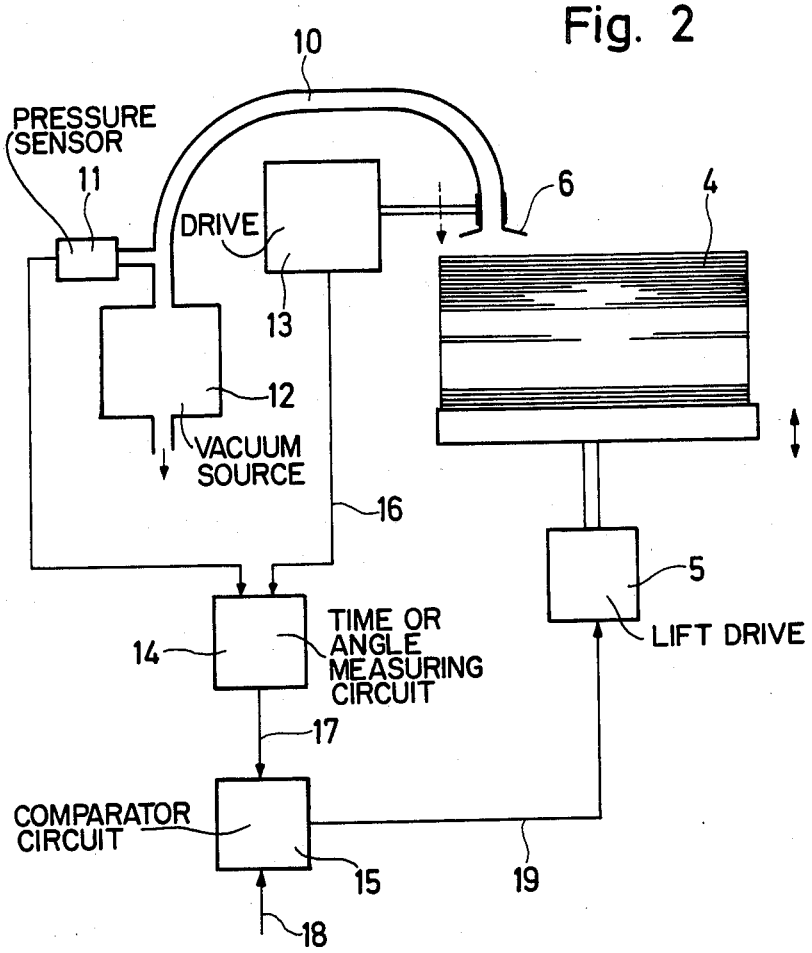

The construction and method of operation of the invention, however, together with additional objects and advantages thereof will be best understood from the following description of specific embodiments when read in connection with the accompanying drawing, in which:

FIG. 1 is a diagrammatic side elevational view of a sheet feeder for printing machines, constructed in accordance with the invention; and FIG. 2 is a working schematic diagram of the sheet feeder.

FIG. 1 shows a printing device 1, which receives the individual sheets from a feed table 2. A paper stack 4 which can be raised by means of a conventional lift drive 5 is provided in a sheet feeder 3. A respective uppermost sheet of the stack 4 is raised into the operating position of the separating suckers 6 and conveyed to the feed table 2 via conveyor suckers 7. In the illustrated embodiment of the invention, the lift drive 5 raises the stack of paper sheets 4 by means of chains 8 and support arms 9 which are secured to the chain 8. The lift drive 5 is controlled in a conventional manner so that it raises the stack of sheets to such an extent that the uppermost sheet is in the operating position for the separating and conveying facilities i.e. the separating suckers 6 and the conveying suckers 7, respectively.

A conventional pressure sensor 11 which detects pressure fluctuations in the suction line 10 is arranged in the suction line 10 of the separating sucker 6 (FIG. 2). These pressure fluctuations occur when the foot of the sucker 6, approaching the stack to raise the sheet, makes contact with the topmost sheet of paper. In this regard, a sudden pressure drop occurs in the suction line which, with respect to the rotation of the machine, occurs at a time directly dependent upon the length of the path which must be covered by the sucker before it makes contact with the uppermost sheet i.e. the relative instant of time of the pressure drop is a reference measure for the respective stack height. It should be assumed, in this regard, that the suction line 10 is connected to a vacuum source 12 which maintains at a constant value the vacuum produced by a pump.

A rotary pulse or angular pulse generator is assigned to the drive 13 of the separating and conveying suckers 6 and 7, respectively, which is driven synchronously with the rotation of the printing machine. Both the pulse of the pressure sensor 11 and the pulses 16 of the conventional rotary or angular pulse generator are fed to a conventional time or angle measuring circuit 14 which feeds a signal 17 corresponding to the respective stack height to a conventional comparator circuit 15 in which this signal 17 is compared with a signal 18 of a conventional non-illustrated rotary pulse generator or angle step generator, the signal 18 being controlled in synchronism with the printing machine. The angle step generator can be a coded disc with several segments as is generally known in the art.

By means of the non-illustrated rotary pulse generator or angle step generator, the signal 18 for the optimum stack height can be introduced so that the deviation of the two signals 17 and 18 can be determined in the conventional comparator circuit 15 from the optimum signal 18 and the difference 19 therebetween directed to a control system for the lift drive 5 which actuates the drive for the lift drive for a corresponding period of time, thereby raising the stack by the necessary amount. After sheets have been consecutively removed from the paper stack 4, the signals which is triggered when the separating suckers 6 makes contact, are delayed consecutively with respect to the signal for the optimum stack height so that a continuous or, if required or desired, pulsed interval sequence of control signals is fed to the stack lift drive causing the stack to be raised. The uppermost sheet to be raised is thus always in the most favorable working position in the vicinity of the separating suckers 6.

FIG. 2 is a schematic control diagram of the sheet feeder in which the signal flow and the switching elements which are provided are illustrated, and in which, in the interest of clarity, the generally known and used control elements have been omitted.

The foregoing is a description corresponding, in substance, to German application P No. 34 32 198.5, dated Sept. 1, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Sheet feeder of a printing machine having sheet separating and conveying facilities and having a stack table which raises a stack of sheets by means of a controlled lift drive so that a respective uppermost sheet of the stack is in an operating position for the sheet separating and conveying facilities, the sheet separating facility comprising separating suckers for raising, in timed sequence, a respective trailing sheet end, as viewed in sheet conveying direction through the feeder, a suction line connecting said separating suckers to a suction source, pressure measuring means connected in said suction line for determining an actual instant of time at which a respective sheet is sucked up by said separating suckers, means for comparing the actual suction instant of time with a nominal suction instant of time generated in synchronism with rotation of the printing machine to determine a difference value, means for comparing said difference value with a value corresponding to an optimum height of the stack of sheets, and lift drive means for raising the stack of sheets to compensate for a given deviation of said difference value from said optimum height value.

2. Sheet feeder of a printing machine having sheet separating and conveying facilities and having a stack table which raises a stack of sheets by means of a controlled lift drive so that a respective uppermost sheet of the stack is in an operating position for the sheet separating and conveying facilities, the sheet separating facility comprising separating suckers for raising, in timed sequence, a respective trailing sheet end, as viewed in sheet conveying direction through the feeder, drive means for said separating suckers having a rotary pulse generator operatively associated therewith, a suction line connecting said separating suckers to a suction source, a pressure sensor connected in said suction line for detecting an actual instant of time at which a respective sheet is sucked up by said separating suckers, comparator circuit means for comparing signals from said pressure sensor corresponding to the actual suction time instant with signals from said rotary pulse generator and outputting a signal corresponding to a time difference value, and comparator means for comparing said signal corresponding to said time difference value with a signal corresponding to an optimum height of the stack of sheets, and lift drive means for raising the stack of sheets to compensate for a given deviation of said difference value from said optimum height value.

3. In a printing machine, a sheet feeder having sheet separating and conveying facilities, a stack table which raises a stack of sheets by means of a controlled lift drive so that a respective uppermost sheet of the stack is in an operating position for the sheet separating and conveying facilities, the sheet separating facility comprising at least one separating sucker for raising, in timed sequence, a respective trailing sheet and, as viewed in sheet conveying direction through the feeder, a suction line connecting said separating sucker to a suction source, a pressure sensor connected in said suction line of said separating sucker, means for driving said separating sucker comprising a first angular pulse generator operatively associated with said separating sucker, a second angular pulse generator operatively associated with a main drive of the printing machine, a comparator circuit having inputs for receiving signals from said pressure sensor, said first angular pulse generator and said second angular pulse generator and having an output for a signal corresponding to the angular difference determined in said comparator circuit, comparator means for comparing said signal corresponding to the angular difference with a signal corresponding to an optimum height of the stack of sheets, and control means for actuating the lift drive for a period of time corresponding to a deviation in said signals.

4. Sheet feeder according to claim 1 including means for varying said nominal suction instant of time as a function of printing speed.

* * * * *